US005638926A

United States Patent [19]

McCrickard

[11] Patent Number: 5,638,926

[45] Date of Patent: Jun. 17, 1997

[54] VEHICLE ENGINE BRAKE

[75] Inventor: Edmond Eugene McCrickard, Franklin, Tenn.

[73] Assignee: United States Gear Corporation, Chicago, Ill.

[21] Appl. No.: 558,349

[22] Filed: Nov. 16, 1995

Related U.S. Application Data

[63] Continuation of Ser. No. 266,232, Jun. 27, 1994, abandoned.

[51] Int. Cl.[6] ..... F02D 9/06

[52] U.S. Cl. ..... 188/273; 123/323

[58] Field of Search ..... 60/324, 325; 123/323; 188/272, 273, 154

[56] References Cited

U.S. PATENT DOCUMENTS

| | | | |
|---|---|---|---|
| 2,833,479 | 5/1958 | Novesky | 60/324 |
| 3,303,348 | 2/1967 | Cox | 290/40 |
| 4,273,208 | 6/1981 | Liermann | 188/273 |
| 4,380,971 | 4/1983 | Tholen | 188/273 |
| 4,669,435 | 6/1987 | Furusawa | 188/273 |
| 5,372,109 | 12/1994 | Thompson | 60/324 |

OTHER PUBLICATIONS

"A Professional Driver's Guide on the Use of PACBRAKE Engine and Exhaust Brakes (Form #5007)", by Pacbrake Manufacturing in cooperation with the U.S. Department of Transportation, Oct. 1992.

"Product Update PACBRAKE (Form 5020, 5032 and 5038)", by Pacbrake Manufacturing, date unkown.

*Primary Examiner*—Robert J. Oberleitner
*Assistant Examiner*—C. T. Bartz
*Attorney, Agent, or Firm*—Gerstman, Ellis & McMillin, Ltd.

[57] ABSTRACT

A vehicle engine brake comprising a vessel for the passage of gases having a main tube and a by-pass tube is provided. The by-pass tube defines a first opening into the main tube and a second opening into a more downstream location of the main tube. A first valve, to regulate the passage of gases through the main tube, is provided within the main tube between the first and second openings defined by the by-pass tube. A second valve to regulate the passage of gasses within the by-pass tube and means for controlling the first valve are also provided. Upon actuation of the first valve, gases in the vessel assist in the braking of the vehicle by creating a pressure change in the engine. The by-pass tube and second valve provide a means for relieving back pressure against the engine without losing continuity in braking assistance.

22 Claims, 4 Drawing Sheets

FIG, 1
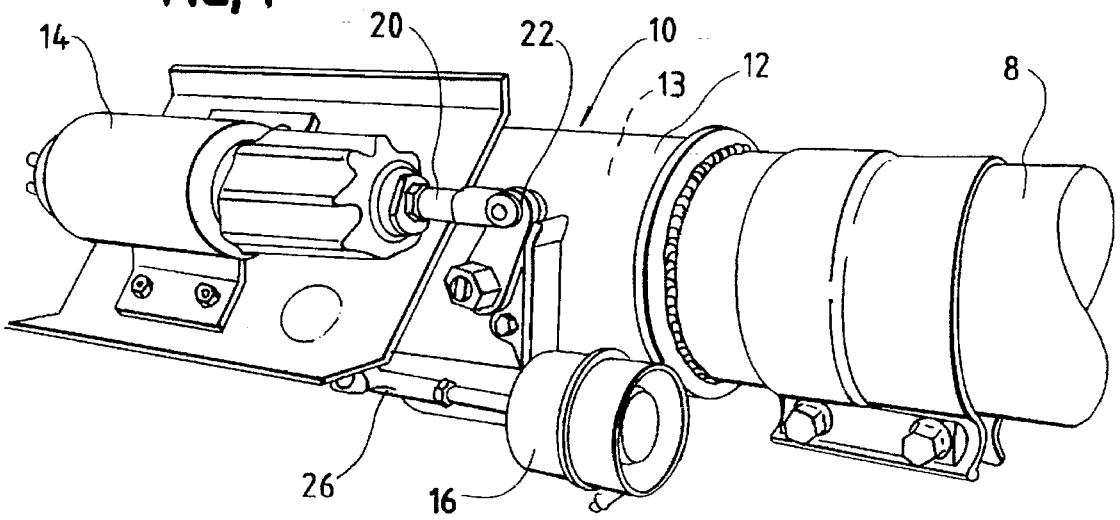
FIG. 2
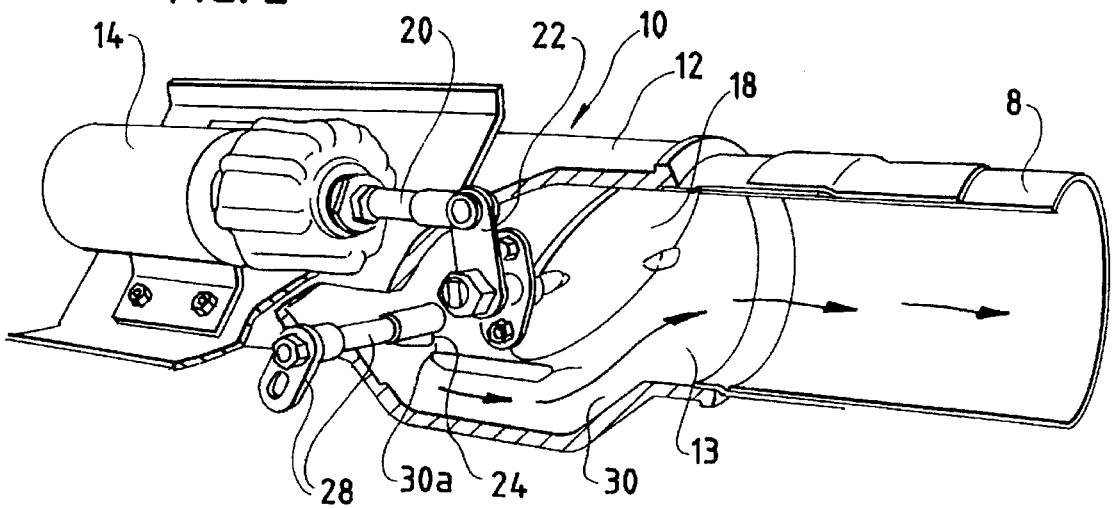

VEHICLE ENGINE BRAKE

This application is a continuation of U.S. application Ser. No. 08/266,232 filed Jun. 27, 1994, now ABN.

FIELD OF THE INVENTION

The present invention concerns a novel vehicle engine brake utilizing engine compression.

BACKGROUND OF THE INVENTION

Diesel engine vehicles are the vehicles of choice for persons towing large loads. The power to pull a load, sometimes two or three times the gross vehicle weight (GVW) of the diesel engine, plus the fuel mileage delivered by diesel engines with such loads, is significantly greater than that possible in similar size gasoline engines.

However, in mountainous or hilly regions or any place where significant grades in roads are found, gasoline engine vehicles hauling loads have an advantage in stopping power over diesel engine vehicles. This advantage is inherent in the design of the gasoline engine, as the gasoline engine is designed with a carburetor that includes a throttle valve, often referred to as a butterfly. When the accelerator, or throttle, is not engaged, as when braking, the butterfly closes off the air intake of the engine forming a compressor effect that assists the vehicle in braking. This is not possible in diesel engines as diesel engines have no analogous structure. When the accelerator of the diesel engine is released, the engine idles with no (or insignificant) change in internal air pressure. No compression is developed and the brakes of the vehicle are given the entire task of stopping the vehicle. When the vehicle has a light load or is on flat land, the brakes are generally adequate on their own, but in the situations described above, generally the brakes are over-exerted and wear out sooner or dangerously overheat.

Valley Fuel Injection, Ltd. of Abbotsford, B.C., Canada, has developed a braking device for use in diesel engine exhaust pipes that purports to produce an effect that is similar to the butterfly of a gasoline engine. Basically, the "BD Engine Brake" causes a compression-type braking effect by causing a valve to close within the exhaust system of a diesel vehicle. The BD brake valve is simply a piece of metal having a shape that fills the cross-section of the exhaust pipe when it is engaged. The BD brake valve can be either open, so that it allows all of the exhaust gases to escape from the engine, as when accelerating, or closed so that it blocks nearly all of the exhaust from the engine when braking. The results are that when the valve is closed a considerable compression force is developed that assists in the braking of the vehicle. When the valve is open, all of the gases escape and no assistance is given to the braking force of the vehicle. When the valve is closed, pressure builds in the exhaust pipe, between the valve and the engine, such that the engine may be damaged or choked and caused to cease operations. To alleviate this, the valve must be periodically opened. However, as noted above, the opening of the valve causes all of the exhaust gases to escape and stops the brake assistance abilities of the BD brake. When the valve is subsequently closed again, pressure must once again build in the exhaust system. The results of using the BD brake are that the user receives peaks and valleys of brake assistance with no continuity to the braking force. Further, there is a danger in using the BD brake in that without due diligence, the brake can cause damage to the engine.

Other manufacturers of similar type brakes have attempted to alleviate the danger of engine damage and choking somewhat by allowing the continuous release of some exhaust gas even when the brake is engaged. This has been done, for example, by perforating the valve so that some exhaust gas escapes all of the time or by causing the valve to not seal completely when closed, for the same effect. Unfortunately, this is a very inaccurate means of regulating pressure and as a result the full effectiveness of the compression braking is not achieved. Further, this means of releasing gases may, due to its inaccuracies, still cause damage to the engine or cause the engine to choke and stall.

I have invented a vehicle engine brake that places an engine in a compression braking mode and can be used in either the exhaust system or in the air-intake system of a vehicle, while allowing excess pressure to be relieved, through regulable means. The present invention provides excellent brake assistance by creating pressure on the engine that causes a compression braking effect and continuity of brake assistance without damaging or choking the engine. Further, as the engine is placed in a compression mode, by the activation of the present device, the engine is allowed to run in such a way that provides a means to bring a diesel engine to operating temperatures and warm up the passenger compartment of a vehicle (on cold days). Previously, diesel engines and passenger compartments had to be started and warmed up by staying in the cold cab while maintaining pressure on the accelerator pedal.

It is therefore an object of the present invention to provide a vehicle engine brake that will assist in the stopping of the vehicle without choking the engine into a stall.

It is a further object of the present invention to provide a means to warm up a diesel engine and the passenger compartment of a diesel vehicle prior to driving the vehicle.

Other objects and advantages of the present invention will become apparent as the description proceeds.

SUMMARY OF THE INVENTION

In accordance with the present invention, a vehicle engine brake comprising a vessel for the passage of gases having a main tube and a by-pass tube, defining a passage for gases, is provided. The by-pass tube defines a first opening into the main tube and also defines a second opening into a more downstream location of the main tube.

A first valve within the main tube, between the first and second openings defined by the by-pass tube is provided to regulate the passage of gases through the main tube. A second valve to regulate the passage of gasses within the by-pass tube itself and means for controlling the first valve are provided. Upon actuation of the first valve, gases in the vessel assist in the braking of the vehicle by creating a pressure change in the engine.

In the exhaust system form of the present device, when engaged, upon the creation of the pressure change in the engine and upon the building up of excess pressure in the device and against the engine, the second valve is pushed open by the excess pressure to relieve the excess pressure. As the pressure is relieved the second valve reseals itself. Thus compression braking pressure is maintained at all times while excess pressure, that could damage or choke the engine, is relieved.

In the air intake system form of the present device, as negative gas pressure builds between the device and the engine the second valve is automatically pulled open to allow air to enter the engine. As the need for air is relieved the second valve reseals itself. This compression braking pressure is maintained at all times while the engine's need of a certain level of oxygen for combustion is provided.

Further, upon starting the engine of a vehicle and engaging the present device on cold days, the pressure caused by the present device causes the engine and passenger cabin (when the vehicle heater is engaged) to warm up more rapidly than otherwise possible. Thus, the vehicle can be at operating temperatures and its passenger compartment can be comfortable prior to moving the vehicle.

A more detailed explanation of the invention is provided in the following description and claims and is illustrated in the accompanying drawings.

BRIEF DESCRIPTION OF THE DRAWINGS

FIG. 1 shows a perspective view of a vehicle engine brake of the present invention and a partial view of the exhaust system of a vehicle.

FIG. 2 shows a perspective view, partially cut away, of an activated vehicle engine brake of the type shown in FIG. 1.

DETAILED DESCRIPTION OF THE ILLUSTRATIVE EMBODIMENT

Figure 3:
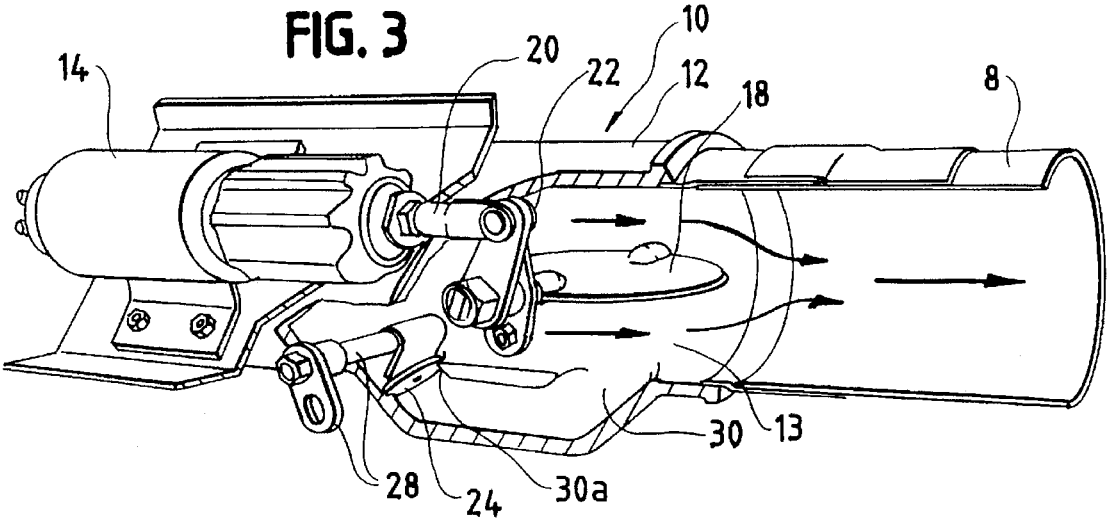
FIG. 3 shows a perspective view, partially cut away, of a deactivated vehicle engine brake of the type shown in FIG. 1

Referring to the drawings, FIGS. 1–3 show a vehicle engine brake 10 attached to the exhaust system 8 of a vehicle. Referring to FIGS. 1–5, engine brake 10 comprises a housing 12 carrying a solenoid motor 14 and an actuator 16 each connected to, and operating, a butterfly valve 18 within the housing 12. Solenoid motor 14 is attached to butterfly valve 18 by piston rod 20 and lever arm 22. Actuator 16 is attached to a pop-valve 24 by a piston 26 and a lever arm system 28. Butterfly valve 18 is carried within housing 12 in main tube 13. Valve 18 can either be in a closed position, as shown in FIG. 2 or in an open position as shown in FIG. 3. FIGS. 2 and 3 show a by-pass tube 30 carried by said housing 12 and having said pop-valve 24 at one end 30a of tube 30.

Figure 4:
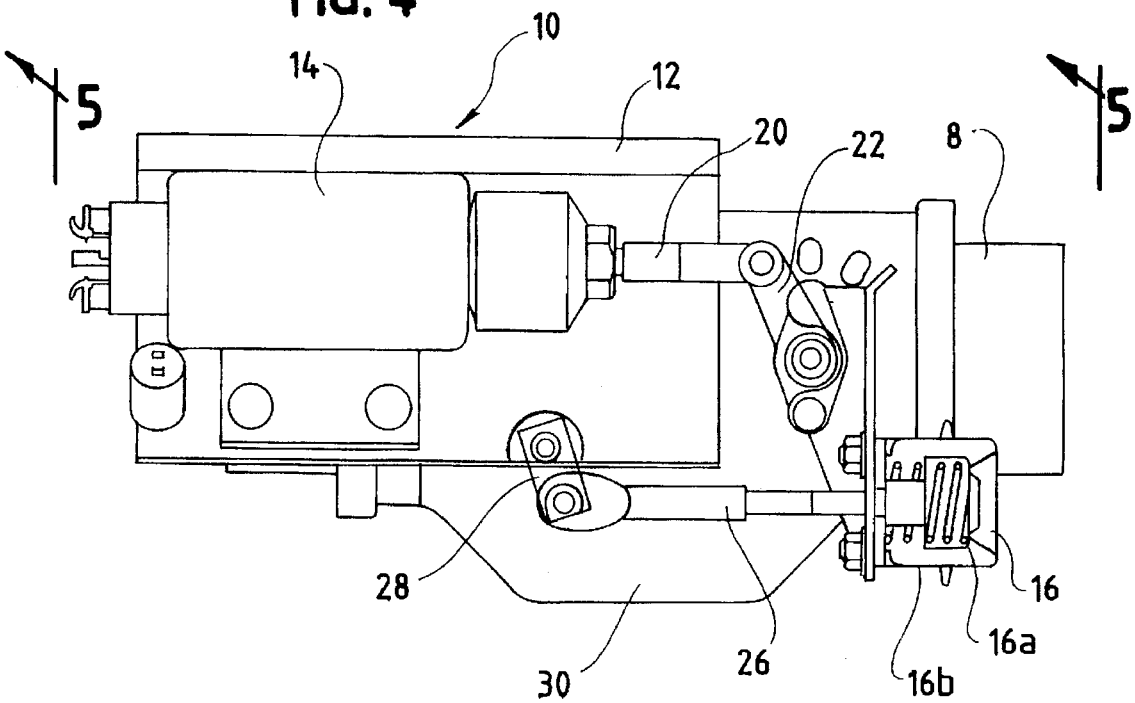
FIG. 4 is an elevational view, partially broken away, of the vehicle engine brake of FIG. 1.

As a result of the pull of actuator 16 on piston 26 and lever arm system 28, pop-valve 24 is at rest forming a seal of tube 30 at end 30*a*. A pressure equivalent to optimal brake assist pressure is exerted upon pop-valve 24 by actuator 16 to keep pop-valve 24 in place and forming a seal in tube end 30*a*. Actuator 16, as shown in FIG. 4, comprises a coil spring 16*a* under compression within an element-protective container 16*b*. Coil spring 16*a* may be adjusted so that its pull is equal to the highest gas pressure that will not damage or choke the particular engine with which the present device is associated. Other means of sensing and relieving pressure including any pressure gauges and electronic valve opening devices, such as a second solenoid motor, used in combination either to automatically respond at a given pressure or to provide warning or readable pressure levels to an operator who may manually open a valve in the by-pass tube may be utilized without changing the scope of the present invention. Further, the use of motors and timers in association with pressure sensing devices may also be used without changing the scope of the present invention.

In the operation of the engine brake 10, when the engine of the vehicle is running and brake assistance is desired, the power button 32 on remote control 34 (FIG. 7) is pressed in the vehicle passenger compartment. Upon the power button 32 being pressed, solenoid motor 14 is activated causing piston rod 20 and lever arm 22 to move butterfly valve 18 to its closed position. With butterfly valve 18 closed, exhaust from the vehicle engine cannot escape and produces a back pressure on the vehicle engine. This back pressure forms compression on the engine that helps the vehicle brake.

Figure 5:
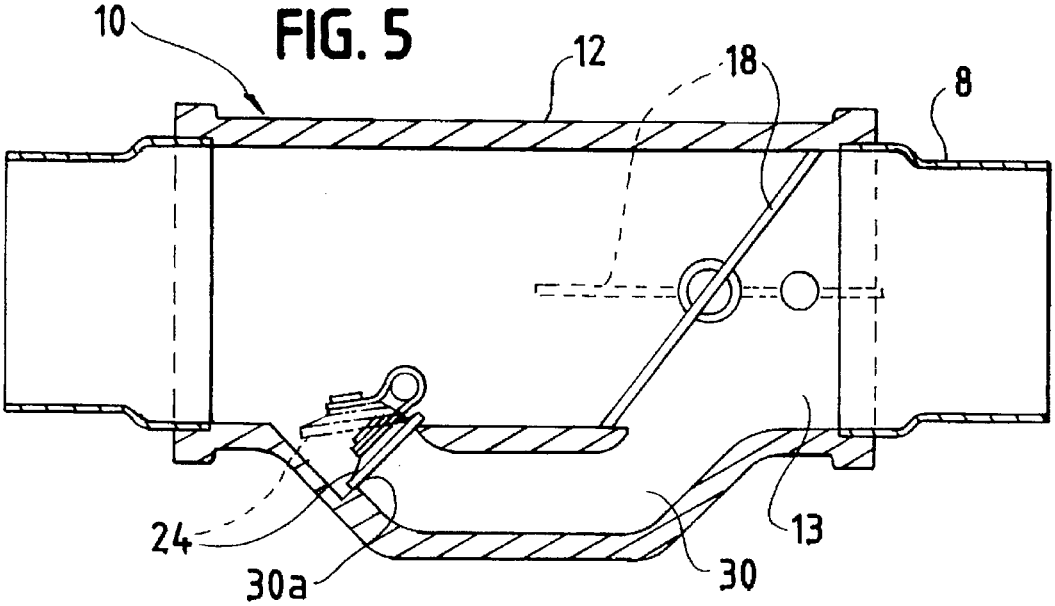
FIG. 5 is a cross-sectional view of the vehicle engine brake of FIG. 1 taken along the plane of line 5—5 of FIG. 4.

When butterfly valve 18 is closed, some gas that normally would pass through main tube 13 is detoured into by-pass tube 30. When pressure in by-pass tube 30 exceeds holding pressure from actuator 16, pop-valve 24 is unseated, as shown in FIGS. 2 and 5, and gas under pressure is allowed to escape. The escape of gas under pressure continues until the pressure in excess of the holding pressure from actuator 16 is released. When the gas pressure in by-pass tube 30 is less than or equal to tube end 30*a* sealing tube 30.

In this way, valve 18 remains closed keeping necessary back pressure against the vehicle engine so as to assist in braking. Further, pressure cannot build so as to stall or damage the engine as relief is provided by pop-valve 24.

Figure 6:
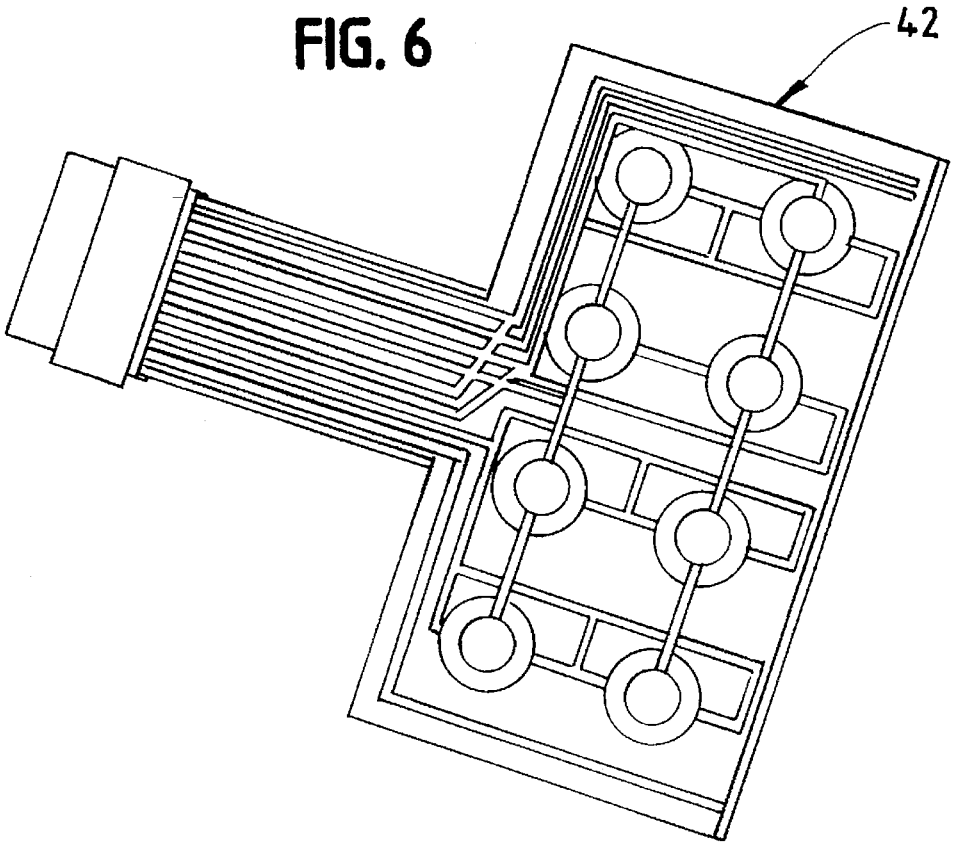
FIG. 6 is a planar view of a typical switch for use with the device of the present invention.
Figure 7:
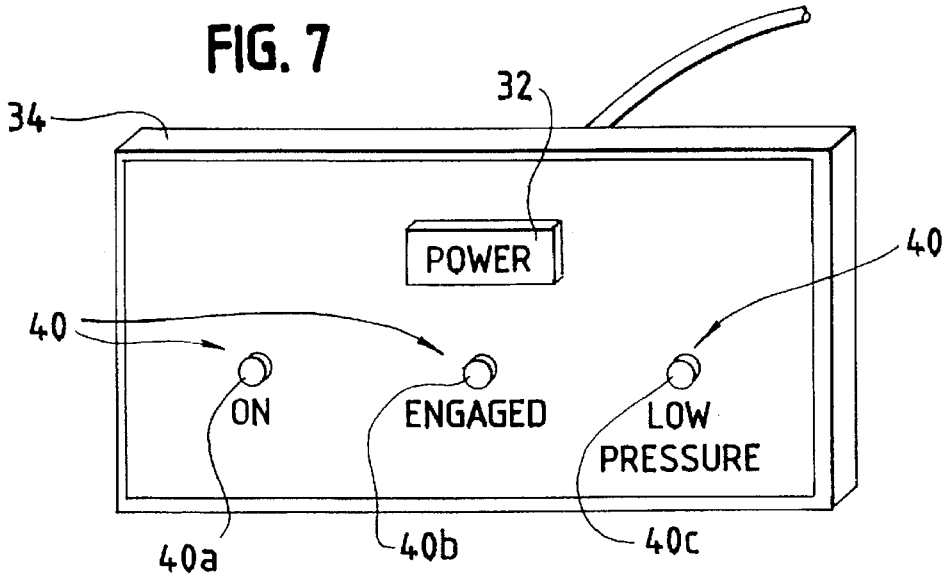
FIG. 7 is a perspective view of a typical remote control for use with the device of the present invention.
Figure 8:
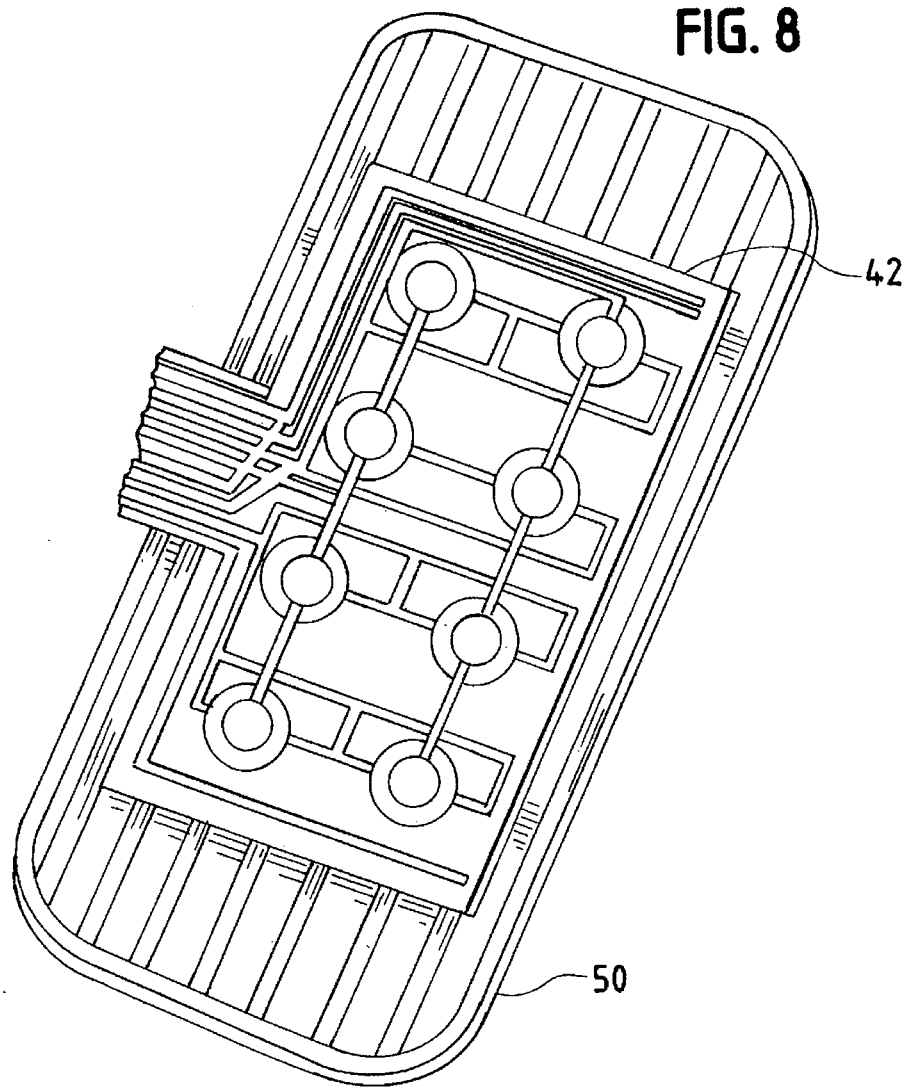
FIG. 8 is a planar view of the switch of FIG. 6 on the accelerator pedal of a typical vehicle in which the device of the present invention may be used.

In the illustrative embodiment of the present invention, as shown in FIG. 7, a remote control 34 with indicator lights 40 is provided. Among the indicators provided on remote control 34 are, a light indicating that the device is on 40*a*, a light indicating that the device is engaged 40*b* and a light indicating that there is not enough pressure in the system to assist in braking 40*c*. Also provided is a cut-off switch 42 that is placed on the accelerator pedal 50. Any variety of switch may be used as a cut-off switch for the present device but preferably a pressure sensitive bubble membrane, as shown in FIG. 6, is used. In the operation of the device, when the power button 32 is pressed the device is activated and the "on" indicator 40*a* lights up. When the device is then needed the vehicle operator presses a remote activator which engages the device and causes the "engaged" indicator 40*b*, on remote control 34 to light up. The remote activator can be of any variety of designs, such as a radio controlled or infrared remote or a hard wired device, and can be placed in a location that is convenient for the operator to reach while driving. When the remote activator is engaged, butterfly valve 18 goes into the closed position causing a build up of pressure on the vehicle's engine. After braking and upon accelerating, the cut-off switch 42, on the accelerator, causes the butterfly valve 18 to move to the open position and causes the "engaged" indicator 40*b* on remote control 34 to blink on and off. The "engaged" indicator 40*b* continues to blink on and off until the vehicle operator releases the accelerator.

In the event that upon releasing the vehicle accelerator after engaging the device, the engine cannot produce enough exhaust to create the pressure necessary to cause compression in the engine and assist in braking, the "low pressure" indicator 40*c* on remote control 34 lights up to indicate the lack of pressure. The vehicle operator can then down shift the vehicle to increase the engine speed and thereby build up pressure, until the "low pressure" indicator 40*c* goes off.

Although an illustrative embodiment of the invention has been shown and described, it is to be understood that various modifications and substitutions may be made by those skilled in the art without departing from the novel spirit and scope of the invention.

What is claimed is:

1. A vehicle engine brake comprising;

a vessel for the passage of gases comprising a main tube and a by-pass tube;

said by-pass tube defining a first opening into said main tube and a second opening into a more downstream location of said main tube, said by-pass tube defining a passage for gases;

a first valve within said main tube, between said first and second openings to regulate the passage of gases and heat of combustion through said main tube;

a second valve, adjacent to said second opening in said main tube defined by said bypass tube and distal from said first opening, to regulate the passage of gases within said by-pass tube, said second valve being located downstream from said first valve; and means for controlling said first valve whereby upon actuation of said first valve, gases in said vessel assist in the braking of the vehicle by creating a pressure change in the engine and heat of combustion is impeded by said first valve prior to contacting said second valve.

2. The vehicle engine brake of claim 1 wherein said by-pass tube relieves excess pressure in said main tube.

3. The vehicle engine brake of claim 1 wherein said second valve is held against said by-pass tube by a spring such that pressure in excess of the force created by said spring is relieved by opening said second valve.

4. The vehicle engine brake of claim 1 wherein said brake is placed in the exhaust system of a vehicle.

5. The vehicle engine brake of claim 1 wherein said means for controlling said first valve include a solenoid motor.

6. The vehicle engine brake of claim 1 wherein said means for controlling said first valve include a solenoid motor with a switch within said vehicle.

7. The vehicle engine brake of claim 1 wherein said means for controlling said first valve are actuated by a remote control.

8. The vehicle engine brake of claim 1 wherein said means for controlling said first valve are disengaged by a cut-off switch.

9. The vehicle engine brake of claim 6 wherein said switch is attached to the accelerator of said vehicle such that operation of the accelerator of said vehicle disengages said engine brake.

10. The vehicle engine brake of claim 1 wherein said means for controlling said first valve are disengaged by a pressure sensitive switch attached to the vehicle's accelerator pedal.

11. A vehicle engine brake-comprising;

a vessel, placed in the exhaust system of a vehicle, for the passage of gases comprising a main tube and a by-pass tube;

said by-pass tube defining a first opening into said main tube and a second opening into a more downstream location of said main tube, said by-pass tube defining a passage for gases;

a first valve within said main tube, between said first and second openings to regulate the passage of gases and heat of combustion through said main tube;

a second valve, adjacent to said second opening in said main tube defined by said by-pass tube and distal from said first opening, to regulate the passage of gases within said by-pass tube, said second valve being located downstream from said first valve, said second valve being held against said by-pass tube by a spring such that pressure in excess of the force created by said spring is relieved by opening said second valve thereby opening said by-pass tube;

a remote control for controlling said first valve whereby upon actuation of said first valve gases in said vessel assist in the braking of the vehicle by creating a pressure change in the engine and heat of combustion is impeded by said first valve prior to contacting said second valve; and, a cut-off switch attached to the accelerator of said vehicle such that operation of the accelerator of said vehicle disengages said engine brake.

12. The vehicle engine brake of claim 11 wherein said means for controlling said first valve include a solenoid motor.

13. The vehicle engine brake of claim 11 wherein said means for controlling said first valve include a solenoid motor with a cabin mounted on-off switch.

14. The vehicle engine brake of claim 11 wherein said means for controlling said first valve are disengaged by a cut-off switch.

15. The vehicle engine brake of claim 11 wherein said cut-off switch is a pressure sensitive switch attached to the vehicle's accelerator pedal.

16. A method of assisting the braking of a vehicle including the steps of:

providing a vessel, for the passage of gases, comprising a main tube and a by-pass tube;

providing a first valve within said main tube for regulating the passage of gases and heat of combustion through said main tube;

providing a second valve adjacent to said second opening in said main tube defined by said by-pass tube and distal from said first opening, for regulating the passage of gases through said by-pass tube, said second valve being located downstream from said first valve;

engaging said first valve to regulate gases to said vessel thereby creating pressure to assist the braking of the vehicle, said engagement of said first valve further impeding heat of combustion prior to contact with said second valve; and opening said second valve to relieve excess pressure in said vessel by by-passing said first valve through said by-pass tube.

17. The method of claim 16 including the step of engaging said first valve by using a remote control.

18. The method of claim 16 including the step of providing a cut-off switch and disengaging said first valve with said cut-off switch.

19. The method of claim 16 including the step of providing a cut-off switch on the accelerator of said vehicle and disengaging said first valve by engaging the vehicle accelerator.

20. A method of assisting the braking of a vehicle including the steps of:

providing a vessel, for the passage of gases, comprising a main tube and a by-pass tube;

providing a first valve, carried within said main tube for regulating the passage of gases and heat of combustion through said main tube;

providing a second valve carried within said vessel, adjacent to said second opening in said main tube defined by said by-pass tube and distal from said first opening, normally closed against said by-pass tube, for regulating the passage of gases through said by-pass tube, said second valve being located downstream from said first valve;

providing a cut-off switch;

engaging said first valve such that all gases to said vessel are blocked, and heat of combustion is impeded prior to contacting said second valve, thereby creating pressure to assist the braking of the vehicle;

opening said second valve to relieve excess pressure in said vessel by by-passing said first valve through said by-pass tube; and engaging said cut-off switch to temporarily disengage said first valve.

21. The method of claim 20 including the step of engaging said first valve by using a remote control.

22. The method of claim 20 including the step of providing said cut-off switch on the accelerator of said vehicle.

* * * * *